US007468346B2

(12) United States Patent
Thekkekandam et al.

(10) Patent No.: US 7,468,346 B2
(45) Date of Patent: Dec. 23, 2008

(54) LOW FOAMING WASHING LIQUID

(75) Inventors: Joseph Thekkekandam, Siler City, NC (US); Anna Starobin, Greensboro, NC (US); Frank Lama, High Point, NC (US)

(73) Assignee: Ecolab Inc., St. Paul, MN (US)

( * ) Notice: Subject to any disclaimer, the term of this patent is extended or adjusted under 35 U.S.C. 154(b) by 337 days.

(21) Appl. No.: 10/870,245

(22) Filed: Jun. 17, 2004

(65) Prior Publication Data

US 2004/0266649 A1 Dec. 30, 2004

Related U.S. Application Data

(60) Provisional application No. 60/484,114, filed on Jun. 30, 2003.

(51) Int. Cl.
*C11D 17/00* (2006.01)

(52) U.S. Cl. ..... 510/220; 510/221; 510/229; 510/235; 510/228; 510/421

(58) Field of Classification Search ..... None
See application file for complete search history.

(56) References Cited

U.S. PATENT DOCUMENTS

| | | | | |
|---|---|---|---|---|
| 3,650,964 | A | 3/1972 | Sedliar et al. | |
| 3,969,258 | A | 7/1976 | Carandang et al. | |
| 4,597,894 | A * | 7/1986 | Abe et al. | 516/118 |
| 5,965,514 | A | 10/1999 | Wierenga et al. | |
| 5,998,358 | A | 12/1999 | Herdt et al. | |
| 6,566,321 | B1 | 5/2003 | Thekkekandam et al. | |
| 2002/0187918 | A1 * | 12/2002 | Urban | 510/505 |
| 2003/0092594 | A1 * | 5/2003 | Ahmed | 510/424 |

* cited by examiner

*Primary Examiner*—Necholus Ogden, Jr.
(74) *Attorney, Agent, or Firm*—Andrew D. Sorensen; Anneliese S. Mayer

(57) ABSTRACT

A low-foaming, liquid composition is disclosed. Methods of making and using the low-foaming, liquid composition are also disclosed.

11 Claims, No Drawings

LOW FOAMING WASHING LIQUID

CROSS-REFERENCE TO RELATED APPLICATIONS

This patent application claims the benefit of priority to U.S. provisional patent application Ser. No. 60/484,114 entitled "LOW FOAMING WASHING LIQUID" filed on Jun. 30, 2003, the subject matter of which is incorporated herein in its entirety.

FIELD OF THE INVENTION

The present invention relates to a liquid composition for use with water to provide a cleaning solution for the removal of food from dishes, flatware and cookware.

BACKGROUND OF THE INVENTION

Soiled dishes, flatware and cooking utensils are normally cleaned in automatic dishwashers that confine the objects to be cleaned within a sealed container. An amount of detergent is dispensed into the container and an amount of water is added and the resulting solution is re-circulated by spray apparatus to remove the undesirable materials from the surface of the objects being cleaned.

The significant agitation of the detergent solution being used precludes the use of detergents that generate significant amounts of foam. Excessive foaming of the detergent solution can cause leakage of the foam from the dishwasher. As a result, low foaming detergents are used that generate little foam. By contrast, when dishes, flatware and cookware are to be cleaned by hand by the ordinary consumer, the presence of foam is considered to be a desirable characteristic. While the presence of foam may or may not promote cleaning, consumers engaged in the manual cleaning process consider foam to correlate with cleaning power.

The use of dishwashing detergents on metal cookware also introduces significant constraints. If the detergent is excessively basic or highly alkaline, then aluminum cookware is attacked, degrading the surface of the cookware. Introduction of corrosion inhibitors may minimize the degradation of the aluminum surface; however, some corrosion inhibitors lead to other undesirable effects, such as residues and formulation constraints.

In commercial applications, "open" washing devices are used to clean dishes, flatware, and cookware. Such devices are essentially an open-topped container (i.e., a large sink-like device) having a means of agitation positioned within the device to continuously agitate and heat a detergent solution therein. Because such devices are not closed, the cleaning operation is observable by the operator. Suitable detergents for use in such a device must have adequate cleaning power without the necessity of high-pressure jets that typically are used in an enclosed system (i.e., a household dishwasher).

Further, in the above-described "open" washing devices, a given cleaning solution may remain in use for periods of up to and greater than 4 hours. During this extended period of time, the cleaning solution creates an environment that is conducive to bacteria growth. Most cleaning solutions require the use of an antimicrobial component in order to minimize the growth of bacteria.

Known liquid detergents currently used in open washing devices possess one or more of the following shortcomings: (1) the detergent forms too much foam under agitation such that foam overflows onto the floor next to the open washing device; (2) the detergent forms too little foam under agitation such that an operator doubts whether the detergent is adequately cleaning the cookware; (3) the detergent is unsuitable for use with aluminum cookware; (4) the detergent has a viscosity, which makes dispensing as a liquid, either manually or automatically, difficult; (5) the detergent has an unacceptable shelf life, which prevents the detergent from having satisfactory commercial utility; and (6) the detergent has inadequate antimicrobial properties.

What is needed to the art is a low-foaming liquid detergent, which provides a controlled amount of foam during agitation in an open washing device, provides adequate cleaning power in soft as well as hard water, and is safe to use with aluminum cookware. Further, what is needed to the art is a user-friendly, low-foaming liquid detergent, which is dispensable as a liquid, either manually or automatically, has an acceptable shelf life, and has antimicrobial properties.

SUMMARY OF THE INVENTION

The present invention addresses some of the difficulties and problems discussed above by the discovery of a low-foaming liquid detergent having a unique combination of components, which results in a cleaning solution having a controlled amount of foaming. The low-foaming liquid detergent finds particular utility in open washing devices, such as those in the fast food industry, for cleaning the surface of dishes, flatware, and especially metal cookware.

Accordingly, the present invention is directed to a low-foaming liquid detergent comprising a balanced combination of components, which result in a cleaning solution having desired properties including, but not limited to, low, controlled foaming; suitable for use with aluminum cookware; dispensable as a liquid, either manually or automatically; an acceptable shelf life; and desirable antimicrobial properties.

In one exemplary embodiment of the present invention, the low-foaming, liquid detergent has antimicrobial properties, and comprises water; a combination of high-foaming surfactants; at least one pH control agent in a total amount to provide a pH of below about 6.0; and at least one foam control agent. Other optional components may be added to the liquid detergent including, but not limited to, a dye, a perfume, and a preservative.

The present invention is also directed to a method of making the low-foaming liquid detergent, and methods of using the low-foaming liquid detergent in open washing devices, such as POWER SOAK® potwashing devices. In one exemplary embodiment, the present invention is directed to a method of washing cookware, wherein the method comprises combining a liquid detergent and water into a power soaking potwashing sink to form a cleaning solution, wherein the liquid detergent comprises water; a combination of high-foaming surfactants; at least one pH control agent in a total amount to provide a pH of below about 6.0; and at least one foam control agent.

The present invention is further directed to systems for washing cookware. One exemplary system for washing cookware comprises a sink having a built-in agitator; a cleaning solution within the sink, wherein the cleaning solution comprises a liquid detergent in combination with water, and the liquid detergent comprises water, a combination of high-foaming surfactants, at least one pH control agent in a total amount to provide a pH of below about 6.0, and at least one foam control agent.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the present invention is intended by the use of specific language. Alterations, further modifications, and such further applications of the principles of the present invention discussed are contemplated as would normally occur to one ordinarily skilled in the art to which the invention pertains.

The present invention is directed to a combination of ingredients, and those skilled in the art may find ways to alter that combination by means of further chemical additions to the solutions specifically disclosed and claimed. Moreover, the amounts set out in embodiments, and even the claims may be changed and still achieve the benefits of the present invention. Such modifications are considered to be within the scope of the present invention, as set out in the attached claims and their equivalents.

The present invention is directed to a low-foaming liquid detergent having a unique combination of components, which results in a cleaning solution having a controlled amount of foaming. The low-foaming liquid detergent contains a balanced combination of high-foaming surfactants and foam control agents in order to produce desired foaming properties. The combination of high-foaming surfactants and foam control agents enables intense agitation of a cleaning solution containing the low-foaming liquid detergent and water without forming an undesirable amount of foam, only a sufficient amount of foam to indicate effective cleaning.

Further, the low-foaming liquid detergent possesses desirable antimicrobial properties due to the unique combination of ingredients. In one exemplary embodiment of the present invention, the low-foaming liquid detergent possesses antimicrobial properties due to a relatively low pH, such as a pH in a range of about 2 to about 6. In this embodiment, the low pH retards bacterial growth without the need to add expensive biocides and/or perservatives to the low-foaming liquid detergent.

In other embodiments of the present invention, one or more biocides and/or perservatives may be added to the low-foaming liquid detergent to provide antimicrobial properties. In this embodiment, the pH may be higher than 5.2.

I. Low-Foaming Liquid Detergent Component

The low-foaming liquid detergent of the present invention comprises a number of components, which provide desired characteristics to the resulting liquid detergent. A description of each class of liquid detergent component is given below.

A. Water

The low-foaming liquid detergent of the present invention comprises water as a primary solvent or carrier. Soft or hard water may be used in the present invention, although soft water is more desirable. As used herein, the term "soft water" refers to water containing less than about 60 ppm of water hardness expressed as calcium carbonate. As used herein, the term "hard water" refers to water containing more than about 60 ppm of water hardness expressed as calcium carbonate, while "very hard water" refers to water containing more than about 180 ppm of water hardness expressed as calcium carbonate. The low-foaming liquid detergent of the present invention may be formed using water available from any municipal water-treatment facility.

The low-foaming liquid detergent of the present invention typically comprises from about 35 to about 90 weight percent (wt %) of water based on a total weight of the low-foaming liquid detergent. Desirably, the low-foaming liquid detergent of the present invention comprises from about 50 to about 75 wt % water based on a total weight of the low-foaming washing detergent. In one desired embodiment of the present invention, the low-foaming liquid detergent comprises about 58 to about 66 wt % water based on a total weight of the low-foaming washing detergent B. High-Foaming Surfactants The low-foaming liquid detergent of the present invention comprises one or more high-foaming surfactants. As used herein, the term "high-foaming surfactant" refers to a surfactant, which produces an excess amount of foam when subjected to agitation in a POWER SOAK® potwashing device without a foam control agent, wherein the "excessive amount" indicates foam overflowing an upper edge of the POWER SOAK® potwashing device. Typically, the distance from the water fill level to the upper edge of the POWER SOAK® potwashing device is about 8.9 cm. (3.5 inches). Incorporation of high-foaming surfactant into a water solution without a foam control agent increases the volume of the liquid and the liquid level during agitation, and eventually the liquid overflows onto the floor.

Suitable high-foaming surfactants for use in the present invention include, but are not limited to, anionic surfactants, nonionic surfactants, and amphoteric surfactants. Anionic surfactants include, but are not limited to, dodecyl benzene sulfonic acid and its salts, alkyl ether sulfates and salts thereof, olefin sulfonates, phosphate esters, soaps, sulfosuccinates, and alkyaryl sulfonates. Nonionic surfactants include, but are not limited to, alkoxylates of alkyl phenols and alcohols, alkanolamides, and amine oxides. Amphoteric surfactants include, but are not limited to, imidazoline derivatives, betaines, and amine oxides. Specific examples of suitable high-foaming surfactants include, but are not limited to, dodecyl benzene sulfonic acid and its salts, nonyl phenoxy ethoxylate, ethoxylated alcohol containing from about 9 to about 15 carbon atoms, diethanol coconut amide, sodium lauryl ether sulfate, and combinations thereof.

The low-foaming liquid detergent of the present invention comprises one or more high-foaming surfactants. In one desired embodiment of the present invention, the low-foaming liquid detergent comprises a combination of two or more high-foaming surfactants, wherein the high-foaming surfactants are selected from linear dodecyl benzene sulfonic acid, nonyl phenoxy ethoxylate, ethoxylated alcohol having from about 9 to about 15 carbon atoms, and diethanol coconut amide. In a further embodiment of the present invention, the low-foaming liquid detergent comprises a combination of high-foaming surfactants, wherein the combination comprises linear dodecyl benzene sulfonic acid, nonyl phenoxy ethoxylate, ethoxylated alcohol having from about 9 to about 15 carbon atoms, diethanol coconut amide, and sodium lauryl ether sulfate.

The low-foaming liquid detergent of the present invention may comprise one or more high-foaming surfactants in an amount of up to about 40 wt % based on a total weight of the low-foaming liquid detergent. Desirably, the one or more high-foaming surfactants are present in an amount ranging from about 5 to about 40 wt % based on a total weight of the low-foaming liquid detergent. More desirably, the one or more high-foaming surfactants are present in an amount ranging from about 15 to about 25 wt % based on a total weight of the low-foaming liquid detergent.

A number of commercially available high-foaming surfactants may be used in the present invention. Suitable commercially available linear dodecyl benzene sulfonic acid surfactants include, but are not limited to, surfactants sold under the trade designation BIOSOFT™, available from Stepan Chemical Company (Northfield, Ill.), such as BIOSOFT™ S-100 and BIOSOFT™ S-101; and surfactants sold under the trade designation WITCO, available from Witco Corporation (Greenwich Conn.), such as WITCO 1298 Soft Acid. Suitable commercially available nonyl phenoxy ethoxylate surfactants include, but are not limited to, surfactants sold under the trade designation SURFONIC®, available from Huntsman Chemical Company (Houston, Tex.), such as SURFONIC® N95; surfactants sold under the trade designation TERGITOL™, available from Dow Chemical Company (Midland, Mich.), such as TERGITOL™ 9.5; and surfactants sold under the trade designation MAKON®, available from Stepan Chemical Company (Northfield, Ill.), such as MAKON® 10. Suitable commercially available ethoxylated alcohols having from about 9 to about 15 carbon atoms include, but are not limited to, surfactants sold under the trade designation SURFONIC®, available from Huntsman Chemical Company (Houston, Tex.), such as SURFONIC® L12-6; and surfactants sold under the trade designation NEODOL®, available from Shell Chemical Co. (Houston, Tex.), such as NEODOL® 91-6. Suitable commercially available diethanol coconut amide surfactants include, but are not limited to, surfactants available under the trade designation NINOL, available from the Stepan Chemical Company (Northfield, Ill.), such as NINOL 40-CO; surfactants sold under the trade designation STANDAMID™, available from Henkel, Canada Ltd. (Ontario, Canada), such as STANDAMID™ SD; and surfactants sold under the trade designation WITCAMIDE, available from Witco Corporation (Greenwich, Conn.), such as WITCAMIDE 82. Suitable commercially available sodium lauryl ether sulfate surfactants include, but are not limited to, surfactants that are sold under the trade designation SULFOTEX™, available from the Henkel Corporation (Cincinnati, Ohio), such as SULFOTEX™ NL-60S and SULFOTEX™ 60/40X; and surfactants sold under the trade designation STEOL™, available from Stepan Chemical Company (Northfield, Ill.), such as STEOL™ CS460.

C. Low-Foaming Surfactants

The low-foaming liquid detergent of the present invention may also include one or more low-foaming surfactants. As used herein, the term "low-foaming surfactant" refers to a surfactant, which does not produce an excess amount of foam when subjected to agitation in a POWER SOAK® potwashing device without a foam control agent (i.e., foam does not overflow an upper edge of the POWER SOAK® potwashing device as described above). Suitable low-foaming surfactants include, but are not limited to, ethoxylated alcohols having from about 6 to about 10 carbon atoms.

One or more low-foaming surfactants may be present in the low-foaming liquid detergent of the present invention in an amount of up to about 10.0 wt % based on a total weight of the low-foaming liquid detergent. Desirably, the low-foaming liquid detergent of the present invention comprises one or more low-foaming surfactants, when present, in an amount of from about 2.0 to about 8.0 wt % based on a total weight of the low-foaming liquid detergent. More desirably, the low-foaming liquid detergent comprises one or more low-foaming surfactants, when present, in an amount of from about 3.0 to about 4.0 wt % based on a total weight of the low-foaming liquid detergent.

Commercially available low-foaming surfactants may be selected from a variety of products including, but not limited to, surfactants sold under the trade designation POLY-TERGENT™, available from BASF Corporation (Charlotte, N.C.), such as POLY-TERGENT™ SLF-18; surfactants sold under the trade designation PLURONIC®, available from BASF Corporation (Mount Olive, N.J.), such as PLURONIC® L-61 block polymer; surfactants sold under the trade designation TRITON™, available from Union Carbide Corporation (South Charleston, W.Va.), such as TRITON™ CF-32; surfactants sold under the trade designation NEODOL®, available from Shell Chemical Co. (Houston, Tex.), such as NEODOL® 91-2.5; and surfactants sold under the trade designation TOMADOL®, available from Tomah[3] Products, Inc. (Milton, Wis.), such as TOMADOL® 91-2.5.

D. pH Control Agents

The low-foaming liquid detergent of the present invention contains one or more pH control agents in order to maintain a pH in a range of about 2.0 to about 6.0. Suitable pH control agents include, but are not limited to, inorganic pH control agents; organic pH control agents; and combinations thereof. Suitable inorganic pH control agents include, but are not limited to, alkali metal hydroxides, such as sodium hydroxide solution or potassium hydroxide solution, and water soluble carbonates or bicarbonates. Suitable organic pH control agents include, but are not limited to, citric acid, sodium citrate, triethanolamine (TEA), monoethanolamine, isopropanolamine, and aminomethyl propanol. Desirably, the pH control agent is citric acid (i.e., 2-hydroxy-1,2,3-propanetricarboxylic acid), lactic acid, tartaric acid, glycolic acid, salicylic acid, 1,4-piperazinebis-(ethanesulfonic acid) (PIPES), fumaric acid, malic acid, itaconic acid, ascorbic acid, succinic acid, and benzoic acid, sodium citrate, sodium hydroxide solution, TEA, or a combination thereof.

The low-foaming liquid detergent of the present invention contains one or more pH control agents in an amount necessary to obtain a pH in the range of about 2.0 to about 6.0. Typically, the one or more pH control agents are present in an amount ranging from about 1.0 to about 15.0 wt % of the low-foaming liquid detergent based on a total weight of the low-foaming liquid detergent; however, this amount will vary depending on the actual amount of acidic materials used in the low-foaming liquid detergent. In one embodiment of the present invention, the low-foaming liquid detergent of the present invention comprises about 4.64 wt % of a sodium hydroxide solution (50 wt % NaOH in water) in combination with about 11.93 wt % of citric acid 50% (50 wt % citric acid in water), wherein the weight percents are based on a total weight of the low-foaming liquid detergent. It should be noted that other sodium hydroxide solutions and citric acid solutions having different concentrations may be used in the present invention.

Commercially available pH control agents include, but are not limited to, Caustic Soda 50%, Rayon grade, available from PPG Industries (Pittsburgh, Pa.) or any other major manufacturer of sodium hydroxide liquid, such as ICI Americas, Inc. (Wilmington, Del.); citric acid 50% (50 wt % citric acid in water), available from Archer Daniels Midland Company, Inc. (Decatur, Ill.) or any other major manufacturer; and sodium citrate available from Gadot Biochemical Industry (Haifa, Israel) or any other major manufacturer.

The low-foaming liquid detergent of the present invention is available in a concentrated form, wherein the above-described pH control agents are present in an amount to desirably provide a pH ranging from about 2.0 to about 6.0, more desirably, from about 3.0 to about 4.0. An end user typically will dilute the concentrated form of the low-foaming liquid detergent to form a "use" solution, which desirably, has a pH ranging from about 4.0 to about 6.0, more desirably, from about 5.0 to about 5.4.

E. Viscosity Control Agents

The low-foaming liquid detergent of the present invention may include one or more viscosity control agents in an amount of up to about 10 wt % based on a total weight of the low-foaming liquid detergent. Suitable viscosity control agents include, but are not limited to, magnesium sulfate, hexahydrate powder or magnesium sulfate solution (i.e., magnesium sulfate in an aqueous solution); acrylic polymer; alcohols such as isopropyl alcohol and ethyl alcohol; cellulose derivatives such as hydroxymethyl or hydroxypropyl cellulose; and combinations thereof. One example of a suitable salt solution for use in the present invention is a magnesium sulfate solution 27% (i.e., 27 wt % magnesium sulfate in an aqueous solution). Other magnesium sulfate solutions having a different concentration may be used in the present invention, as well as, other salt powders and other salt solutions.

Commercially available viscosity control agents include, but are not limited to, a magnesium sulfate 27% liquid solution sold under the trade designation EPSOM LIQUID 27%, available from Giles Chemical Corporation (Waynesville, N.C.); acrylic polymers sold under the trade designation ACUSOL®, available from Rohm and Haas (Glen Allen, Va.), such as ACUSOL® 820 and ACUSOL® 880; acrylic polymers sold under the trade designation GOODRITE™, available from B.F.Goodrich Specialty Chemicals (Cleveland, Ohio), such as GOODRITE™ K 7058; and poly(ethylene oxide) sold under the trade designation POLYOX™, available from Union Carbide Corporation (Danbury, Conn.), such as POLYOX™ WSR N60K.

F. Foam-Control Agents

The low-foaming liquid detergent of the present invention contains at least one foam-control agent. Suitable foam-control agents include, but are not limited to, silicones such as polydimethyl siloxanes, silanols derived from silanes, perfluorinated acids, and combinations thereof. Any of the above-mentioned foam-control agents may further include silica particles and other materials such as mineral oils. Examples of possible mineral oils include, but are not limited to, KLEAROL™ White mineral oil available from Crompton Corporation (Petrolia, Pa.) and ISOPAR™ M mineral oil available from ExxonMobil (Houston, Tex.).

The low-foaming liquid detergent may comprise one or more foam-control agents, typically in an amount of up to about 2.5 wt % based on a total weight of the low-foaming liquid detergent. In one desired embodiment of the present invention, the low-foaming liquid detergent comprises from about 0.01 to about 2.0 wt % of one or more foam-control agents, based on a total weight of the low-foaming liquid detergent. When the foam-control agent is present in the form of a solution, the active ingredient (e.g., the silicone component) is typically present in an amount of up to about 100.0 wt % based on a total weight of the foam-control agent solution. Consequently, the amount of active foam-control agent is typically present in the low-foaming liquid detergent in an amount of up to about 2.0 wt % based on a total weight of the low-foaming liquid detergent, more typically, about 0.01 to about 0.15 wt % based on a total weight of the low-foaming liquid detergent.

Commercially available foam-control agents suitable for use in the present invention include, but are not limited to, foam control agents sold under the trade designation FOAM BLAST®, available from Ross Chemical Company (Fountain Inn, S.C.), such as FOAM BLAST® 552; foam control agents available from Harcross Chemicals (Kansas City, Mo.), such as Harcross Silicone AF-10 FG; foam control agents available from Dow Corning Corp. (Midland, Mich.), such as Dow Corning 1510 Silicone; and foam control agents sold under the trade designation FLUOWET®, available from Clariant Corp. (Charlotte, N.C.), such as FLUOWET® PL-80.

In one desired embodiment of the present invention, the low-foaming liquid detergent contains up to about 0.5 wt % of FOAM BLAST® 552 based on a total weight of the low-foaming liquid detergent. FOAM BLAST® 552 is a proprietary mixture containing hydrophobic silica, ethylene oxide/propylene oxide copolymer, silanols derived from silanes, and small amounts of nonionic surfactants.

G. Hydrotropes

The low-foaming liquid detergent of the present invention may also include one or more hydrotropes in an amount of up to about 15 wt % of a total weight of the low-foaming liquid detergent. Suitable hydrotropes include, but are not limited to, sodium xylene sulfonate (SXS), disodium alkyl diphenyloxide disulfonates, and combinations thereof. Specific examples of disodium alkyl diphenyloxide disulfonates include, but are not limited to, sodium dodecyl diphenyloxide disulfonate. In one desired embodiment of the present invention, the low-foaming liquid detergent of the present invention comprises a combination of hydrotropes in an amount of from about 8 to about 10 wt % based on a total weight of the low-foaming liquid detergent. Desirably, the combination of hydrotropes comprises from about of 3.8 to about 5.0 sodium xylene sulfonate (40% solution, i.e., 40 wt % SXS in water) and from about of 4.6 to about 6.0 of sodium dodecyl diphenyloxide disulfonate.

Commercially available hydrotropes include, but are not limited to, sodium xylene sulfonate (SXS) available under the trade designation STEPANATE™ from Stepan Company (Northfield, Ill.), such as STEPANATE™ SXS; and sodium dodecyl diphenyloxide disulfonate available under the trade designation RHODACAL™ from Rhodia Inc. (Cranbury, N.J.), such as RHODACAL™ DSB.

H. Additives

The low-foaming liquid detergent of the present invention may contain one or more additives to provide a desired characteristic to the low-foaming liquid detergent. Suitable additives include, but are not limited to, dyes, pigments, perfumes, preservatives, and combinations thereof. In one desired embodiment of the present invention, the low-foaming liquid detergent comprises at least one dye to provide a desirable color, at least one perfume to provide a desirable scent, and at least one preservative to prevent bacterial growth within the low-foaming liquid detergent.

Typically, additives such as dyes, perfumes, and preservatives, are each individually present in an amount of less than about 0.1 wt % based on a total weight of the low-foaming liquid detergent. Desirably, the amount of dye in the low-foaming liquid detergent, when present, ranges from about 0.0005 to about 0.01 wt % based on a total weight of the low-foaming liquid detergent. When a perfume is present, the amount of perfume is desirably from about 0.01 to about 0.1 wt % based on a total weight of the low-foaming liquid detergent. Desirably, one or more preservatives are present in the low-foaming liquid detergent in an amount ranging from about 0.001 to about 0.01 wt % based on a total weight of the low-foaming liquid detergent.

A number of commercially available additives may be used in the present invention. Commercially available dyes suitable for use in the present invention include, but are not limited to, Blue Pylaklor LX 10092 available from Pylam Products (Tempe, Ariz.); Resorcine Brown 5GM available from Pylam Products (Tempe, Ariz.); and Tartrazine Yellow available from Chemcentral (Romulus, Mich.). Commercially available perfumes suitable for use in the present invention include, but are not limited to, perfume SZ-6929 (Apple) available from J. E. Sozio, Inc. (Edison, N.J.); Citrus SZ 6242 available from J. E. Sozio, Inc. (Edison, N.J.); and MF 3773 (lemon) available from Mane, USA (Wayne, N.J.). Commercially available preservatives suitable for use in the present invention include, but are not limited to, preservatives sold under the trade designation UCARCIDE™, available from (Union Carbide Corp., Danbury, Conn.), such as UCARCIDE™ 250.

II. Method of Making the Low-Foaming Washing Liquid

The low-foaming liquid detergent of the present invention may be prepared using conventional mixing techniques at room temperature. When a high viscosity, low-foaming liquid detergent is prepared, the components, when present, are desirably combined in the following order while mixing: water, viscosity control agents, pH control agents, surfactants, hydrotropes, foam control agents, and then additives such as perfumes, dyes and preservatives. As used herein, the term "high viscosity" refers to a solution having a viscosity of greater than or equal to about 150 centipoise (cps). Typically, a high viscosity low-foaming liquid detergent of the present invention has a viscosity ranging from about 150 cps to about 450 cps. As used herein, the term "low viscosity" refers to a solution having a viscosity of less than about 150 cps. Typically, a low viscosity low-foaming liquid detergent of the present invention has a viscosity ranging from about 30 cps to less than about 150 cps.

When a low viscosity, low-foaming liquid detergent is prepared, the components, when present, are desirably combined in the following order while mixing: water, pH control agents, surfactants, hydrotropes, viscosity control agents, foam control agents, and then additives such as perfumes, dyes and preservatives.

III. Methods of Using the Low-Foaming Washing Liquid

The low-foaming liquid detergent of the present invention may be used in a variety of applications including, but not limited to, household, commercial, and industrial applications. The low-foaming washing liquid detergent of the present invention is particularly suitable for use with open washing devices, such as POWER SOAK® potwashing systems available from MetCraft Corporation (Grandview, Mo.), as well as other pot and pan washing systems, such as those disclosed in U.S. Pat. No. 4,773,436, assigned to Cantrell Industries, Inc. (Olathe, Kans.), the subject matter of which is hereby incorporated by reference. Suitable MetCraft POWER SOAK® potwashing systems include, but are not limited to, the MetCraft MX-220-H POWER SOAK® Potwashing System.

One desired method of use for the low-foaming liquid detergent of the present invention is in the custom food service industry. Fast food service companies desire a cleaning system, which may be used throughout a given workday (i.e., 12 hours or more per day). In one method of the present invention, a desired amount of the low-foaming liquid detergent is added to a MetCraft POWER SOAK® Potwashing System. Desirably, the amount of low-foaming liquid detergent ranges from about 1.0 cc (0.03 oz.) to about 5.0 cc (0.17 oz) of low-foaming liquid detergent per gallon of water. The POWER SOAK® Potwashing System is filled with water at a desired temperature, typically from about 43.3° C. (110° F.) to about 46.1° C. (115° F.), to an operating level (typically about 8.9 cm. (3.5 inches) from an upper edge of the POWER SOAK® potwashing device) and the water-agitation mechanism of the POWER SOAK® apparatus is initiated. Pots and other food-preparation items are typically soaked in the POWER SOAK® Potwashing System for a period of up to four hours. The pots and/or food-preparation items are then removed from the low-foaming liquid detergent, rinsed and sanitized prior to use.

In one embodiment of the present invention, a method of washing dishes, pots, or other food-preparation items comprises soaking the items in a POWER SOAK® Potwashing System, wherein the soaking solution comprises a low-foaming liquid detergent having a composition as shown in Table 1 below.

TABLE 1

Exemplary Low Foaming Liquid Detergent Formulations

| Chemical Component | Desired Range (wt %) | More Desired Range (wt %) |
|---|---|---|
| water | ~50.0 to ~80.0 | ~60.0 to ~70.0 |
| citric acid, 100% | up to ~4.0 | ~0.4 to ~1.5 |
| sodium citrate | up to ~6.0 | ~2.0 to ~3.5 |
| poly(ethylene oxide) with fumed silica solution | up to ~2.0 | ~0.01 to ~1.0 |
| ethoxylated alcohol having $C_{10-12}$ moieties | up to ~10.0 | ~4.0 to ~6.5 |
| ethoxylated alcohol, a low-foaming surfactant | up to ~10.0 | ~3.0 to ~5.0 |
| linear dodecyl benzene sulfonic acid | ~5.0 to ~20.0 | ~12.0 to ~17.5 |
| diethanol coconut amide | up to ~6.0 | ~1.0 to ~3.0 |
| sodium lauryl ether sulfate | up to ~7.0 | ~3.0 to ~5.0 |
| blue dye | up to ~0.01 | ~0.0 to ~0.002 |
| perfume | up to ~0.1 | ~0.04 to ~0.07 |
| preservative | up to ~0.10 | ~0.0 to ~0.02 |
| foam control agent | up to ~2.0 | ~0.2 to ~0.6 |

In a further embodiment of the present invention, a method of washing dishes, pots, or other food-preparation items comprises soaking the items in a POWER SOAK® Potwashing System, wherein the soaking solution comprises a low-foaming liquid detergent having a composition as shown in Table 2 below. In this embodiment, sodium hydroxide and citric acid are combined to form sodium citrate in situ.

TABLE 2

Exemplary Low Foaming Liquid Detergent Formulations

| Chemical Component | Desired Range (wt %) | More Desired Range (wt %) |
|---|---|---|
| water | ~40.0 to ~70.0 | ~43.0 to ~60.0 |
| sodium hydroxide, 50% | up to ~8.0 | ~4.5 to ~6.0 |
| citric acid, 50% | up to ~18.0 | ~11.8 to ~15.0 |
| sodium xylene sulfonate, 40% | up to ~6.0 | ~3.5 to ~5.5 |
| sodium dodecyl diphenyloxide disulfonate | up to ~8.0 | ~4.0 to ~6.5 |
| linear dodecyl benzene sulfonic acid | ~5.0 to ~20.0 | ~10.0 to ~15.5 |
| ethoxylated alcohol having $C_{10-12}$ moieties | up to ~10.0 | ~4.0 to ~6.5 |
| ethoxylated alcohols having $C_{9-11}$ moieties | up to ~6.0 | ~1.0 to ~2.5 |
| blue dye | up to ~0.01 | ~0.0005 to ~0.0015 |
| perfume | up to ~0.1 | ~0.03 to ~0.06 |
| preservative | up to ~0.10 | ~0.0 to ~0.02 |
| foam control agent | up to ~2.0 | ~0.2 to ~0.6 |

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

The materials shown in Table 1 are used in the examples below.

TABLE 1

| Chemicals Used In Examples | | |
|---|---|---|
| Material | Description | Manufacturer |
| **High-Foaming Surfactants** | | |
| BIOSOFT ™ S-101 | linear dodecyl benzene sulfonic acid | Stepan Chemical Company Northfield, Illinois |
| NINOL ™ 40-CO | diethanol coconut amide | Stepan Chemical Company Northfield, Illinois |
| STEOL ® CS460 | sodium lauryl ether sulfate | Stepan Chemical Company Northfield, Illinois |
| SURFONIC ® L12-6 | ethoxylated alcohol having $C_{10-12}$ moieties, | Huntsman Corp. Houston, TX |
| **Low-Foaming Surfactants** | | |
| POLY-TERGENT ™ SLF-18 | ethoxylated alcohol, a low-foaming surfactant | BASF Corporation Charlotte, NC |
| NEODOL ® 91-2.5 | ethoxylated alcohol having $C_{9-11}$ moieties (2.5 mole ethylene oxide per mole of alcohol) | Shell Chemical Co. Houston, TX |
| **Foam Control Agents** | | |
| FOAM BLAST ® 552 | silica-glycol copolymer foam control agent | Ross Chemical Company Fountain Inn, SC |
| **pH Control Agents** | | |
| Caustic Soda 50% Rayon grade | sodium hydroxide, 50% solution, a pH control agent | PPG Industries Pittsburgh, PA |
| citric acid, 100% | citric acid, 100% | Archer Daniels Midland Company Decatur, IL |
| citric acid, 50% | citric acid, 50 wt % aqueous solution | Archer Daniels Midland Company Decatur, IL |
| sodium citrate | sodium citrate | Gadot Biochemical Industry Haifa, Israel |
| **Viscosity Control Agents** | | |
| POLYOX ™ WSR N60K | poly(ethylene oxide) with fumed silica | Union Carbide Corporation Danbury, CT |
| **Hydrotropes** | | |
| STEPANATE ™ SXS | sodium xylene sulfonate | Stepan Chemical Company Northfield, Illinois |
| RHODACAL ™ DSB | sodium dodecyl diphenyloxide disulfonate | Rhodia Inc. Cranbury, NJ |
| **Preservatives** | | |
| UCARCIDE ™ 250 | preservative (biocide) | Union Carbide Corporation Danbury, CT |

TABLE 1-continued

| Chemicals Used In Examples | | |
|---|---|---|
| Material | Description | Manufacturer |
| **Colorants** | | |
| Blue Pylaklor LX 10092 | dye | Pylam Products Tempe, AZ |
| **Perfumes** | | |
| SZ 6949, Apple | perfume | J. E. Sozio, Inc. Edison, NJ |

Example 1

Preparation of a Low Foaming Washing Liquid

A low foaming washing liquid detergent was prepared having the formulation as shown in Table 4 below and a total solution weight of 100 kilograms (kg.).

TABLE 4

| Low Foaming Washing Liquid | | | |
|---|---|---|---|
| Chemical Name | Chemical Component | Net. Wt. | Wt % |
| Water | water, City of Greensboro, NC | 65.65 kg | 65.65% |
| SURFONIC ® L12-6 | ethoxylated alcohol C10-12 | 5.00 kg | 5.00% |
| POLY-TERGENT ™ SLF-18 | ethoxylated alcohol | 4.00 kg | 4.00% |
| BIOSOFT ™ S-101 | linear dodecyl benzene sulfonic acid | 15.00 kg | 15.00% |
| NINOL ™ 40-CO | diethanol coconut amide | 2.00 kg | 2.00% |
| STEOL ® CS460 | sodium lauryl ether sulfate | 4.00 kg | 4.00% |
| FOAM BLAST ® 552 | silica-glycol copolymer foam control agent | 400 g | 0.40% |
| UCARCIDE ™ 250 | preservative | 10 g | 0.01% |
| SZ 6949, Apple | perfume | 60 g | 0.06% |
| sodium citrate | sodium citrate | 2.63 kg | 2.63% |
| citric acid, 100% | citric acid, 100% | 1.05 kg | 1.05% |
| POLYOX ™ WSR N60K | poly(ethylene oxide) with fumed silica | 200 g | 0.20% |

About 165 grams of the washing liquid was poured into a POWER SOAK® potwashing device from Metcraft, Inc. (Grandview, Mo.), Model No. MX-220-H, having a solution capacity of about 0.20 $m^3$ (54 gallons). The device was filled with water to the fill line, approximately 8.26 cm (3.25 in.) from an upper rim of the device. About 50 grams of a typical food soil, such as chicken grease, was added to mimic conditions in the field. Agitation was initiated, and continued for a period of 4 hours.

A desirable amount of foam was observed continuously throughout the 4 hour period. The foam remained inside the boundaries of the potwashing device without overflowing onto the floor.

Example 2

Preparation of a Low Foaming Washing Liquid

A low foaming washing liquid detergent was prepared having the formulation as shown in Table 5 below and a total solution weight of 100 kilograms (kg).

TABLE 5

Low Foaming Washing Liquid

| Chemical Name | Chemical Component | Net. Wt. | Wt % |
|---|---|---|---|
| Water | water, City of Greensboro, NC | 45.449 kg | 45.449% |
| Caustic Soda 50% Rayon grade | sodium hydroxide, 50% solution, a pH control agent | 5.8 kg | 5.8% |
| citric acid, 50% | citric acid, 50 wt % aqueous solution | 14.9 kg | 14.9% |
| STEPANATE ™ SXS | sodium xylene sulfonate | 4.9 kg | 4.9% |
| RHODACAL ™ DSB | sodium dodecyl diphenyloxide disulfonate | 5.9 kg | 5.9% |
| BIOSOFT ™ S-101 | linear dodecyl benzene sulfonic acid | 14.7 kg | 14.7% |
| SURFONIC ® L12-6 | ethoxylated alcohol C10-12 | 5.9 kg | 5.9% |
| NEODOL ® 91-2.5 | ethoxylated alcohol having $C_{9-11}$ moieties (2.5 mole ethylene oxide per mole of alcohol) | 2.0 kg | 2.0% |
| SZ 6949, Apple | perfume | 50 g | 0.05% |
| FOAM BLAST ® 552 | silica-glycol copolymer foam control agent | 400 g | 0.40% |
| Blue Pylaklor LX 10092 | dye | 1 g | 0.001% |

About 164 grams of the washing liquid was poured into a POWER SOAK® potwashing device from Metcraft, Inc. (Grandview, Mo.), Model No. MX-220-H, having a solution capacity of about 0.20 $m^3$ (54 gallons). The device was filled with water to the fill line, approximately 8.26 cm (3.25 in.) from an upper rim of the device. About 50 grams of a typical food soil, such as chicken grease, was added to mimic conditions in the field. Agitation was initiated, and continued for a period of 4 hours.

A desirable amount of foam was observed continuously throughout the 4 hour period. The foam remained inside the boundaries of the potwashing device without overflowing onto the floor.

Example 3

Preparation of a Low Foaming Washing Liquid

A low foaming washing liquid detergent was prepared having the formulation as shown in Table 6 below and a total solution weight of 100 kilograms (kg).

TABLE 6

Low Foaming Washing Liquid

| Chemical Name | Chemical Component | Net. Wt. | Wt % |
|---|---|---|---|
| Water | water, City of Greensboro, NC | 56.36 kg | 56.36% |
| Caustic Soda 50% Rayon grade | sodium hydroxide, 50% solution, a pH control agent | 4.64 kg | 4.64% |
| citric acid, 50% | citric acid, 50 wt % aqueous solution | 11.92 kg | 11.92% |
| STEPANATE ™ SXS | sodium xylene sulfonate | 3.92 kg | 3.92% |
| RHODACAL ™ DSB | sodium dodecyl diphenyloxide disulfonate | 4.72 kg | 4.72% |
| BIOSOFT ™ S-101 | linear dodecyl benzene sulfonic acid | 11.76 kg | 11.76% |
| SURFONIC ® L12-6 | ethoxylated alcohol C10-12 | 4.72 kg | 4.72% |
| NEODOL ® 91-2.5 | ethoxylated alcohol having $C_{9-11}$ moieties (2.5 mole ethylene oxide per mole of alcohol) | 1.6 kg | 1.6% |
| SZ 6949, Apple | perfume | 40 g | 0.04% |
| FOAM BLAST ® 552 | silica-glycol copolymer foam control agent | 320 g | 0.32% |
| Blue Pylaklor LX 10092 | dye | 1 g | 0.001% |

About 164 grams of the washing liquid was poured into a POWER SOAK® potwashing device from Metcraft, Inc. (Grandview, Mo.), Model No. MX-220-H, having a solution capacity of about 0.20 $m^3$ (54 gallons). The device was filled with water to the fill line, approximately 8.26 cm (3.25 in.) from an upper rim of the device. About 50 grams of a typical food soil, such as chicken grease, was added to mimic conditions in the field. Agitation was initiated, and continued for a period of 4 hours.

A desirable amount of foam was observed continuously throughout the 4 hour period. The foam remained inside the boundaries of the potwashing device without overflowing onto the floor.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A low-foaming, liquid detergent having antimicrobial properties, said detergent comprising:

water;

a combination of high-foaming surfactants comprising linear dodecyl benzene sulfonic acid and an ethoxylated alcohol having $C_{9-12}$ moieties therein;

a pH control agent in a total amount to provide a pH of about 5.0 to 5.4 and comprising a combination of citric acid and sodium hydroxide; and at least one foam control agent, wherein the at least one foam control agent comprises:

at least one silicone selected from the group consisting of polydimethyl siloxanes, and a silanol derived from a silane;

perfluorinated acid;

and at least one component selected from silica particles, mineral oil, hydrophobic silica, ethylene oxide/propylene oxide copolymer, and nonionic surfactant.

2. The detergent of claim 1, wherein the combination of high-foaming surfactants further comprises an ethoxylated alcohol having $C_{10-12}$ moieties therein, diethanol coconut amide, sodium lauryl ether sulfate, and combinations thereof.

3. The detergent of claim 1, further comprising a low-foaming surfactant selected from ethoxylated alcohols having from about 6 to about 10 carbon atoms; and an ethoxylated alcohol having $C_{9-11}$ moieties therein with 2.5 mole ethylene oxide per mole of alcohol.

4. The detergent of claim 1, further comprising one or more additives selected from a dye, a perfume, a preservative, and combinations thereof.

5. The detergent of claim 1, wherein the detergent does not contain a preservative.

6. The detergent of claim 1, wherein the detergent comprises a composition containing:

water in an amount ranging from about 50.0 to about 80.0 weight percent (wt %);
citric acid in an amount of up to about 4.0 wt %;
sodium citrate in an amount of up to about 6.0 wt %;
poly(ethylene oxide) in an amount of up to about 2.0 wt %;
an ethoxylated alcohol having from ten to twelve carbon atoms therein in an amount of up to about 10.0 wt %;
an ethoxylated alcohol having from 6 to 10 carbon atoms therein in an amount of up to about 10.0 wt %;
linear dodecyl benzene sulfonic acid in an amount ranging from about 5.0 to about 20.0 wt %;
diethanol coconut amide in an amount of up to about 6.0 wt %;
sodium lauryl ether sulfate in an amount of up to about 7.0 wt %;
an optional dye in an amount of up to about 0.01 wt %;
an optional perfume in an amount of up to about 0.1 wt %;
an optional preservative in an amount of up to about 0.10 wt %; and
the at least one foam control agent in an amount of up to about 2.0 wt % wherein all weight percentages are based on a total weight of the low-foaming, liquid detergent composition.

7. The detergent of claim 6, wherein the detergent comprises a composition containing:

water in an amount ranging from about 60.0 to about 70.0 weight percent (wt %);
citric acid in an amount of from about 0.4 to about 1.5 wt %;
sodium citrate in an amount from about 2.0 to about 3.5 wt %;
poly(ethylene oxide) in an amount of from about 0.01 to about 1.0 wt %;
an ethoxylated alcohol having from ten to twelve carbon atoms therein in an amount of from about 4.0 to about 6.5 wt %;
an ethoxylated alcohol having from 6 to 10 carbon atoms therein in an amount of from about 3.0 to about 5.0 wt %;
linear dodecyl benzene sulfonic acid in an amount ranging from about 12.0 to about 17.5 wt %;
diethanol coconut amide in an amount of from about 1.0 to about 3.0 wt %;
sodium lauryl ether sulfate in an amount of from about 3.0 to about 5.0 wt %;
an optional dye in an amount of up to about 0.002 wt %;
a perfume in an amount of from about 0.04 to about 0.07 wt %;
an optional preservative in an amount of up to about 0.02 wt %; and
the at least one foam control agent in an amount of from about 0.2 to about 0.6 wt %, wherein all weight percentages are based on a total weight of the low-foaming, liquid detergent composition.

8. The detergent of claim 1, wherein the detergent comprises a composition containing:

water in an amount ranging from about 40.0 to about 70.0 weight percent (wt %);
sodium hydroxide, 50% solution, in an amount of up to about 8.0 wt %;
citric acid, 50% solution, in an amount of up to about 18.0 wt %;
sodium xylene sulfonate in an amount of up to about 6.0 wt %;
sodium dodecyl diphenyloxide disulfonate in an amount of up to about 8.0 wt %;
linear dodecyl benzene sulfonic acid in an amount ranging from about 5.0 to about 20.0 wt %;
an ethoxylated alcohol having from ten to twelve carbon atoms therein in an amount of up to about 10.0 wt %;
an ethoxylated alcohol having from 9 to 11 carbon atoms therein in an amount of up to about 6.0 wt %;
an optional dye in an amount of up to about 0.01 wt %;
an optional perfume in an amount of up to about 0.1 wt %;
an optional preservative in an amount of up to about 0.10 wt %; and
the at least one foam control agent in an amount of up to about 2.0 wt %;

wherein all weight percentages are based on a total weight of the low-foaming, liquid detergent composition.

9. The detergent of claim 8, wherein the detergent comprises a composition containing:

water in an amount ranging from about 40.0 to about 70.0 weight percent (wt %);
sodium hydroxide, 50 % solution, in an amount of from about 4.5 to about 6.0 wt %;
citric acid, 50 % solution, in an amount of from about 11.8 to about 15.0 wt %;
sodium xylene sulfonate in an amount of from about 3.5 to about 5.5 wt %;
sodium dodecyl diphenyloxide disulfonate in an amount of from about 4.0 to about 6.5 wt %;
linear dodecyl benzene sulfonic acid in an amount ranging from about 10.0 to about 15.5 wt %;
an ethoxylated alcohol having from ten to twelve carbon atoms therein in an amount of from about 4.0 to about 6.5 wt %;
an ethoxylated alcohol having from 9 to 11 carbon atoms therein in an amount of from about 1.0 to about 2.5 wt %;
an optional dye in an amount of up to about 0.01 wt %;
an optional perfume in an amount of up to about 0.1 wt %;
the at least one foam control agent in an amount of up to about 2.0 wt %;

wherein all weight percentages are based on a total weight of the low-foaming, liquid detergent composition.

10. A cleaning solution comprising the detergent of claim 1 and water, wherein the cleaning solution comprises from about 1.0 to about 5.0 grams of detergent per gallon of water.

11. A low-foaming, liquid detergent having antimicrobial properties, wherein the detergent comprises a composition containing:

water in an amount ranging from about 40.0 to about 70.0 weight percent (wt %);
sodium hydroxide, 50 % solution, in an amount of from about 4.5 to about 6.0 wt %;
citric acid, 50% solution, in an amount of from about 11.8 to about 15.0 wt %;

sodium xylene sulfonate in an amount of from about 3.5 to about 5.5 wt %;

sodium dodecyl diphenyloxide disulfonate in an amount of from about 4.0 to about 6.5 wt %;

linear dodecyl benzene sulfonic acid in an amount ranging from about 10.0 to about 15.5 wt %;

an ethoxylated alcohol having from ten to twelve carbon atoms therein in an amount of from about 4.0 to about 6.5 wt %;

an ethoxylated alcohol having from 9 to 11 carbon atoms therein in an amount of from about 1.0 to about 2.5 wt %;

an optional dye in an amount of up to about 0.01 wt %;

an optional perfume in an amount of up to about 0.1 wt %;

at least one foam control agent in an amount 0.01 about 2.0 wt % comprising: at least one silicone selected from the group consisting of polydimethyl siloxanes, and a silanol derived from a silane;

perfluorinated acid;

and at least one component selected from silica particles, mineral oil, hydrophobic silica, ethylene oxide/propylene oxide copolymer and nonionic surfactant;

wherein all weight percentages are based on a total weight of the low-foaming, liquid detergent composition.

* * * * *